US006941756B1

(12) United States Patent
Lieggi

(10) Patent No.: US 6,941,756 B1
(45) Date of Patent: Sep. 13, 2005

(54) TANKLESS HOT WATER HEATER

(76) Inventor: Damien Lieggi, 2715 Oak St. Ext., Youngstown, OH (US) 44505

( * ) Notice: Subject to any disclaimer, the term of this patent is extended or adjusted under 35 U.S.C. 154(b) by 0 days.

(21) Appl. No.: 10/767,902

(22) Filed: Jan. 29, 2004

Related U.S. Application Data

(63) Continuation-in-part of application No. 10/441,326, filed on May 20, 2003, now Pat. No. 6,684,822.

(51) Int. Cl.[7] ..... F22B 3/06; F01K 13/00
(52) U.S. Cl. ..... 60/645; 126/26; 126/247
(58) Field of Search ..... 60/643, 645, 670; 126/12.3 R, 12.3 B, 26, 247

(56) References Cited

U.S. PATENT DOCUMENTS 4,271,790 A * 6/1981 Ahmed et al. ..... 122/26
4,312,322 A 1/1982 Frelhage
4,387,701 A 6/1983 Gibbons
4,554,906 A 11/1985 Newman, Sr. et al.
4,596,209 A 6/1986 Haslach, Jr.
5,392,737 A 2/1995 Newman, Sr. et al.
6,684,822 B1 * 2/2004 Lieggi ..... 122/26

* cited by examiner

*Primary Examiner*—Hoang Nguyen
(74) *Attorney, Agent, or Firm*—Harpman & Harpman

(57) ABSTRACT

An inline heating device for fluid has rotary members frictionally engaging a fixed heat exchanger chamber defining a central fluid transfer conduit. The rotary members are rotated by a drive shaft having a multiple vein turbine assembly adjacent the heat exchanger chamber fluid transfer conduit being driven by the fluid flow therethrough. The rotary members have enhanced friction engagement surface portions which are spring urged against a portion of the heat exchanger chamber generating heat therein for thermal transfer to the fluid flow therewithin.

5 Claims, 8 Drawing Sheets

TANKLESS HOT WATER HEATER

This is a CIP patent application of Ser. No. 10/441,326, filed May 20, 2003 now U.S. Pat. No. 6,684,822.

BACKGROUND OF THE INVENTION

1. Technical Field

This device relates to heating devices that utilize friction coefficients to generate heat and more particularly to fluid heating devices for domestic hot water use.

2. Description of Prior Art

Prior art within this field has been directed to a variety of heat generating devices utilizing friction to heat fluid, see for example U.S. Pat. Nos. 4,312,322, 4,387,701, 4,554,906, 4,596,209 and 5,392,737.

In U.S. Pat. No. 4,312,322 a disk friction heater is disclosed wherein a plurality of disks are driven by a motor. The disks are spaced within a housing and surrounded by oil which heats as the disks rotate.

A fluid friction furnace is illustrated in U.S. Pat. No. 4,387,701 having a plurality of rotating disks and stationery plates within an enclosure filled with heat transfer fluid. An external motor drives the disk producing heat between the disks and the plates.

U.S. Pat. No. 4,554,906 discloses a tankless friction boiler system having rotary members slidably engaged in a housing. An electric motor drives the members producing heat within a fluid transfer environment.

U.S. Pat. No. 4,596,209 a wind turbine heat generating device is disclosed wherein a wind driven turbine drives a positive displacement pump with adjustable outlets causing fluid to be heated as it passes through the restricted outlets.

Finally, a friction heater is claimed in U.S. Pat. No. 5,392,737 in which a motor rotates a stator that generates heat transfer through a fluid filled housing in communication therewith.

SUMMARY OF THE INVENTION

An economical point of use hot water heating device that requires no outboard energy input utilizing the fluid flow dynamics to generate heat that is in turn transferred to the fluid flow. A pair of turbine assemblies are placed within a restricted fluid flow path rotating outboard friction heating elements generating heat with a thermal heat sink within the fluid's path. The friction engagement elements are configured to maximize thermal generation and transfer to the fluid.

DESCRIPTION OF THE PREFERRED EMBODIMENT

Figure 1:
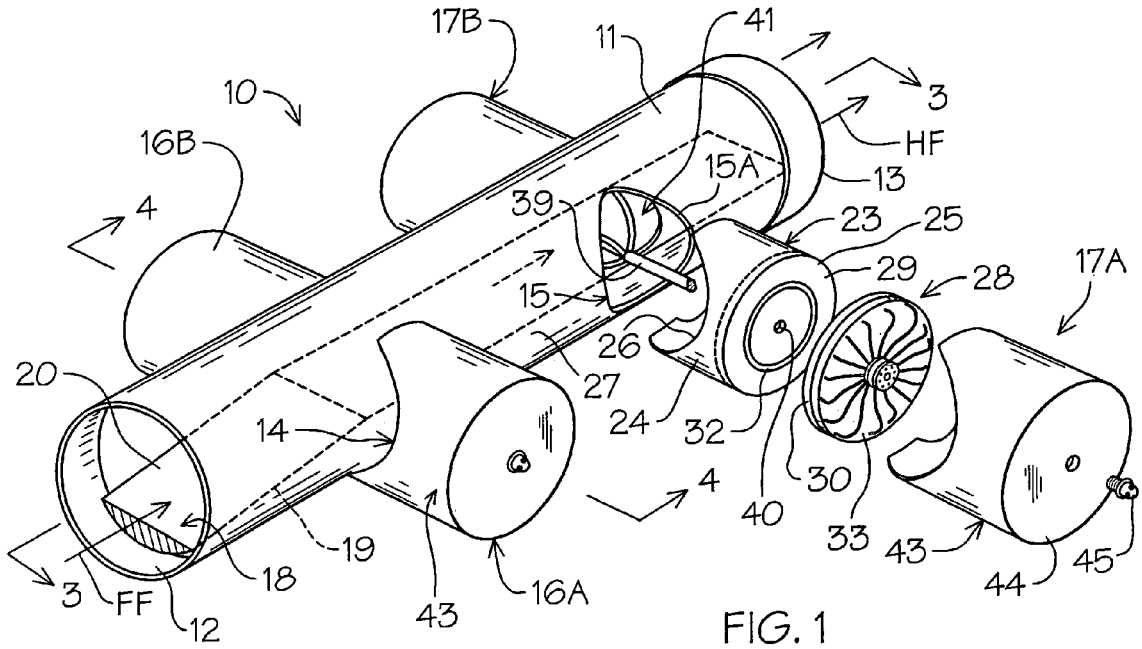
FIG. 1 is a partial exploded perspective view of the tankless hot water heater of the invention.

Referring to FIG. 1 of the drawings, a friction fluid heating device 10 of the invention can be seen having a main cylindrical body member 11 with oppositely disposed open ends at 12 and 13. The cylindrical body member 11 has pairs of longitudinally spaced transversely aligned openings at 14 and 15 therein. Each of the opening pairs 14 and 15 define annular outlets 14A and 14B, 15A and 15B for receiving identical thermal generating assemblies 16A and 16B, 17A and 17B, best seen in FIGS. 1, 2 and 3 of the drawings.

Figure 2:
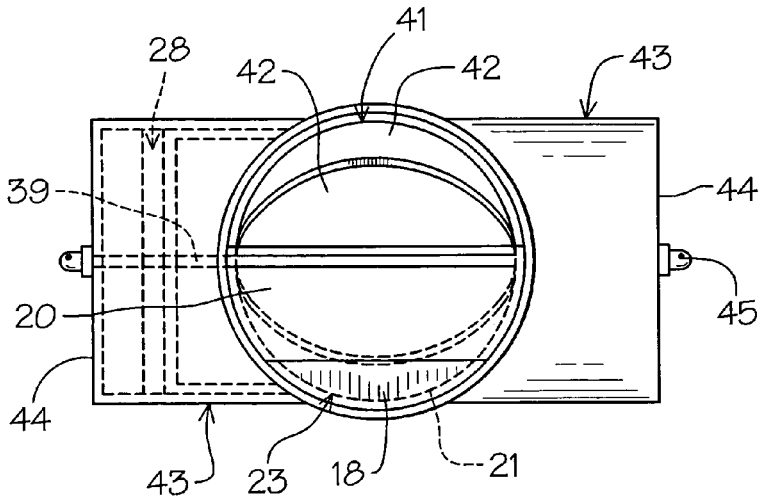
FIG. 2 is an enlarged end plan view thereof.
Figure 3:
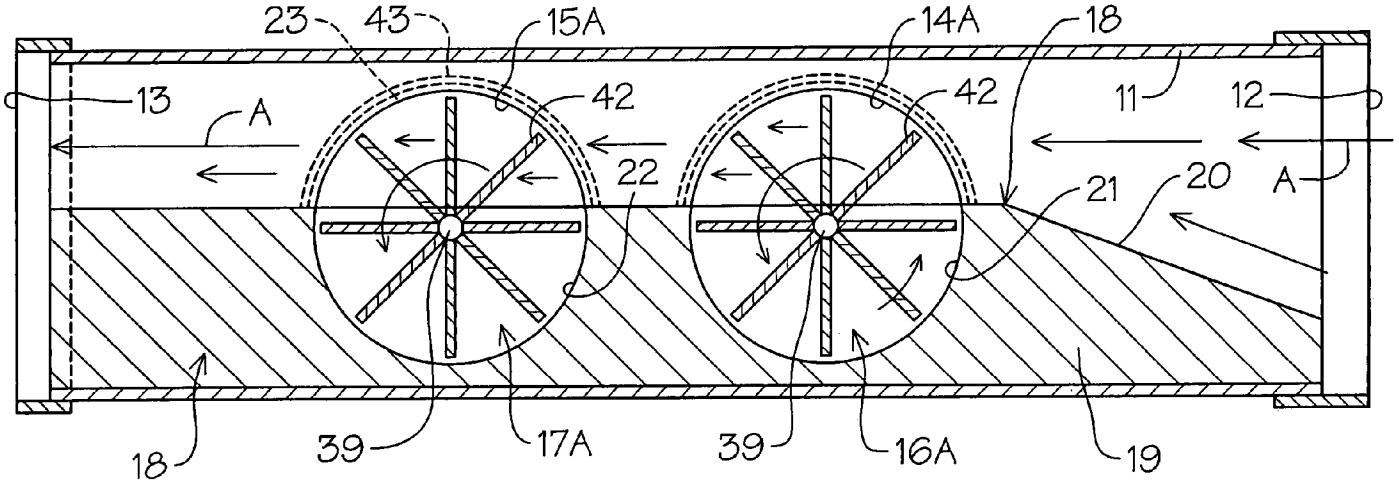
FIG. 3 is an enlarged cross-sectional view on lines 3—3 of FIG. 1.

A cylinder insert 18 best seen in FIGS. 1 and 2 of the drawings has an elongated body member 19 with a tapered end portion 20 and a pair of longitudinally spaced arcuate recesses at 21 and 22 therein. The recesses 21 and 22 are aligned between the respective annular outlets 14A and 14B, 15A and 15B as will be discussed in greater detail hereinafter.

Figure 4:
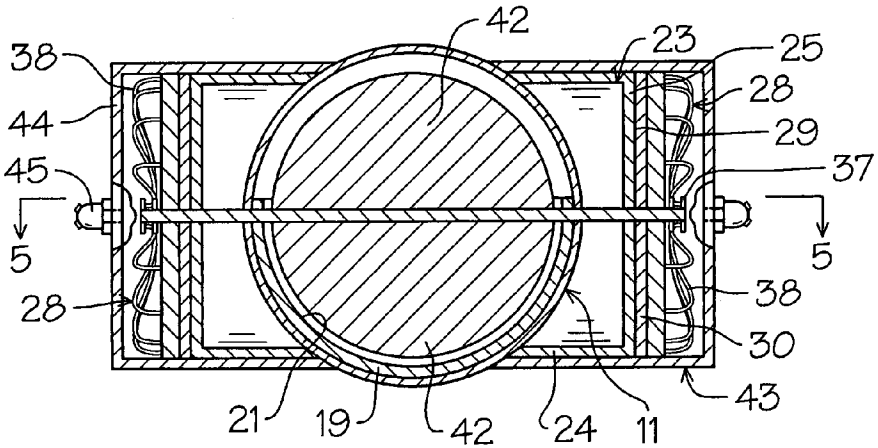
FIG. 4 is an enlarged cross-sectional view on lines 4—4 of FIG. 1.
Figure 5:
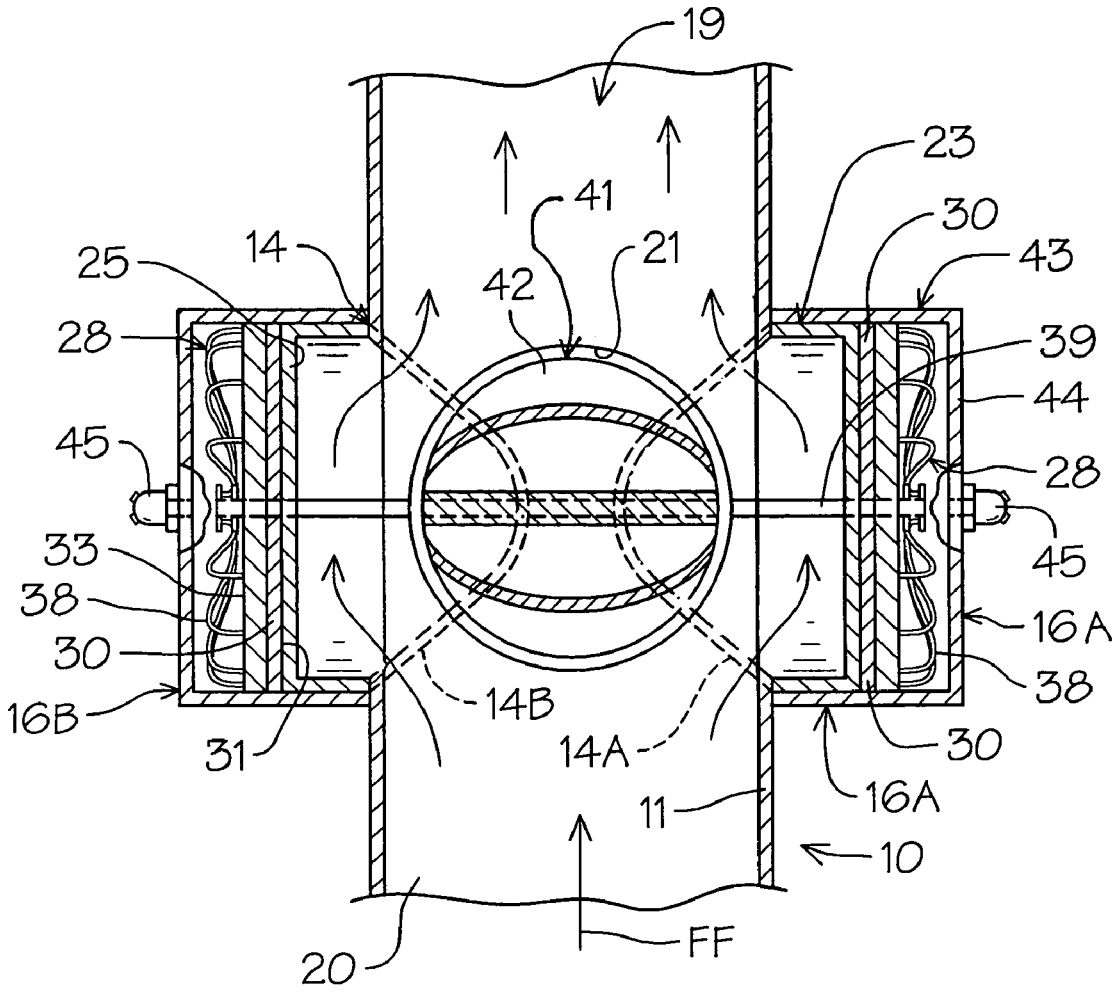
FIG. 5 is an enlarged cross-sectional view on lines 5—5 of FIG. 4.
Figure 6:
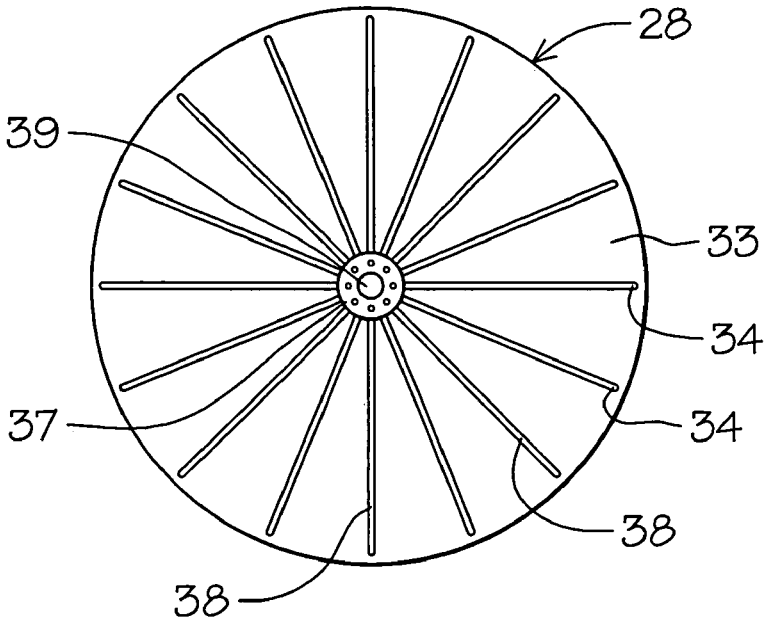
FIG. 6 is an enlarged front elevational view of a friction disk and spider spring assembly of the invention.
Figure 7:
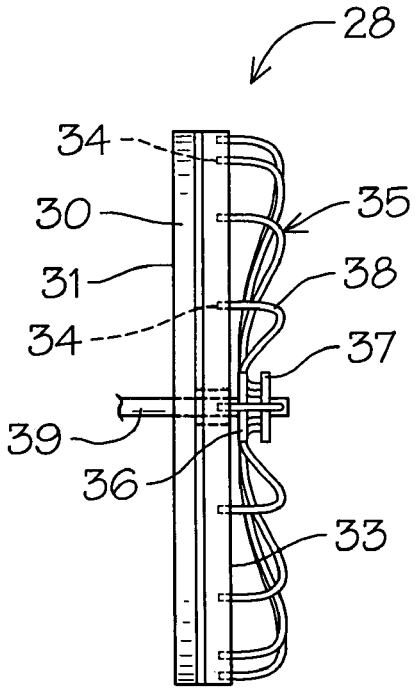
FIG. 7 is an enlarged right side elevational view thereof.
Figure 8:
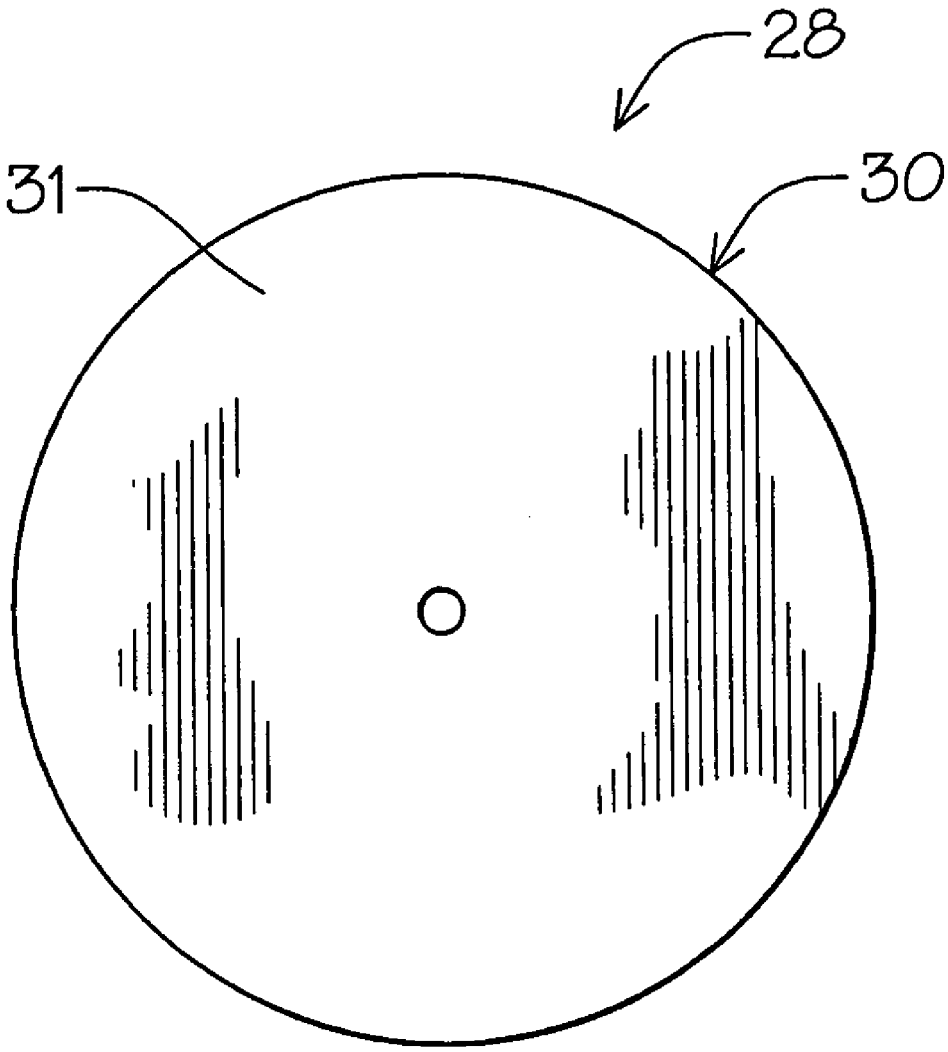
FIG. 8 is an enlarged rear elevational view thereof.

Each of the thermal generating assemblies comprises a thermal engagement transfer housing 23 with a cylindrical side wall 24 and integral end cap portion 25 thereon. The side wall 24 is cut along its perimeter free edge in a contoured pattern at 26 to conform with respective curved surfaces 27 of the main cylindrical body member 11 around the perimeter of the respective annular outlet openings 14A and 14B, 15A and 15B over which the housing 23 will enclose as best seen in FIG. 4 of the drawings.

A friction disk assembly 28 is engageable against the outer surface 29 of the end cap portion 25. The friction disk assembly 28 has a centrally apertured grinding wheel 30 with an engagement surface 31, best seen in FIGS. 6 and 8 of the drawings. The engagement surfaces 31 registerably engage respective end cap portions 25 each of which has an annular wear band 32 embedded within that provides for enhanced frictional engagement therewith. Oppositely disposed surface 33 of the disk assembly 28 have a plurality of annularly spaced mounting sockets 34 therein for registerably receiving a spider spring 35 as seen in FIGS. 6, 7, 8 and 9 of the drawings.

The spider spring 35 has a dual centered apertured hubs 36 and 37 with multiple aligned openings therein for holding individual spring conductor wire and elements 38. The spider spring 35 acts as a resilient chuck maintaining the grinding wheel 30 in frictional contact while diminishing initial rotational torque upon starting up as will be well understood by those skilled in the art.

The friction disk assemblies 28 are secured to respective drive shafts 39 that extend through aligned apertures 40 in the housings 23 from turbine blade assemblies 41 within the cylindrical body member 11.

The turbine blade assemblies 41 each have a plurality of half arcuate blades 42 mounted radially on respective drive shafts 39. The turbine blade assemblies 41 are positioned within the respective cylinder insert recesses 21 and 22, best seen in FIG. 2 of the drawings.

The cylindrical insert 18 as thus described acts as a fluid flow diverter to channel the fluid flow across one-half of the respective turbine blade assemblies 41 indicated by directional arrows A and FF. The frictional disk assemblies 28 are enclosed in a secondary fluid tight cylinder housing 43 that is registerably positioned over the hereinbefore described first housing 18 and against the respective curved surfaces 27 of the cylinder 11.

Apertured integral end closures caps 44 have pressure relief valves 45 on each respectively which provide a safety relief for cylinder housing 43. The relief valves 45 have graduated pressure setting dependent on their position with the system, best seen in FIGS. 1, 2 and 3 of the drawings.

In use, the direct fluid flow FF spins the blades 42 and attached drive shafts 39 rotating the respective friction disk assemblies 28 against the outer end caps 25 surfaces 29 of the housing 23. The kinetic energy inherent therein is converted to thermal output in the form of heat within the transfer housing 23. As a portion of the fluid flow FF passes through the transfer housing 23, the heat generated is given up to heat the fluid F as it passes.

In the preferred embodiment the two respective turbine blade assemblies 41 and multiple interconnected thermal generating assemblies 16A and 16B, 17A and 17B assemblies act in an inline manner providing hot fluid HF from the exit end 13 of the heating device 10 of the invention.

Figure 9:
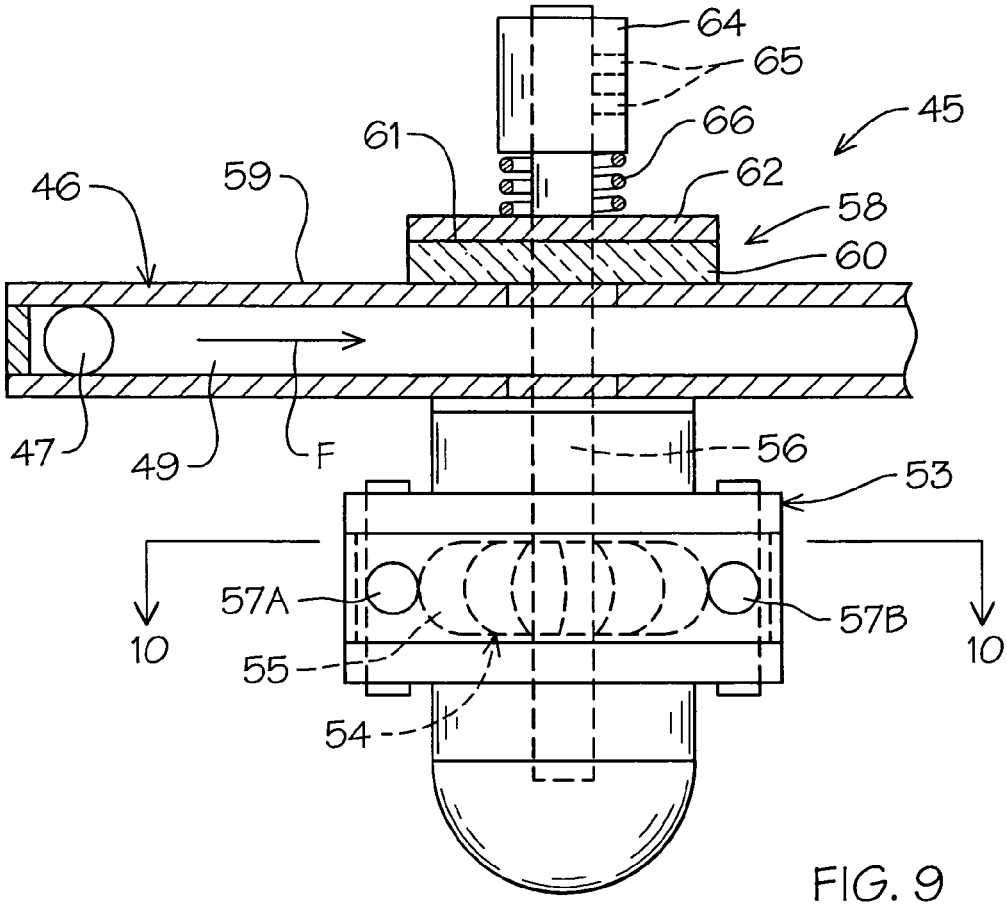
FIG. 9 is an enlarged partial cross-sectional view of an alternate form of the invention.
Figure 10:
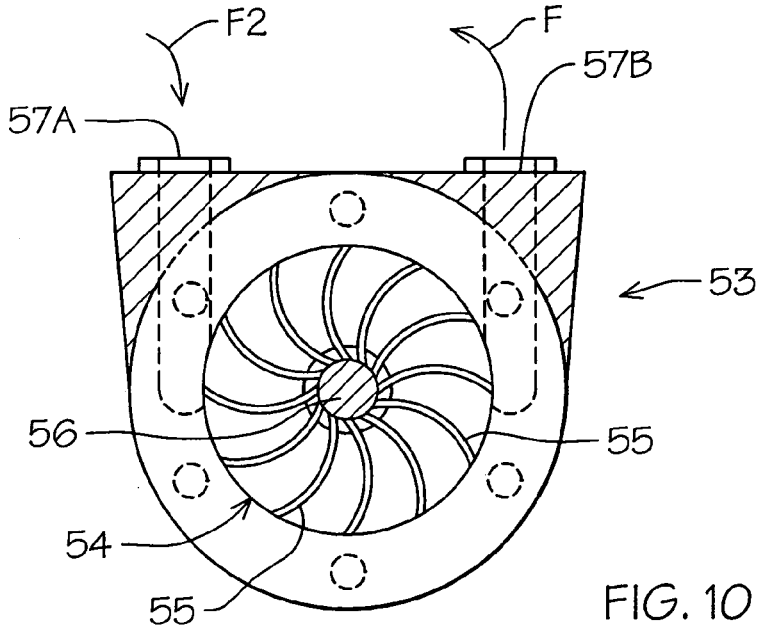
FIG. 10 is an enlarged cross-sectional view on lines 10—10 of FIG. 9.
Figure 11:
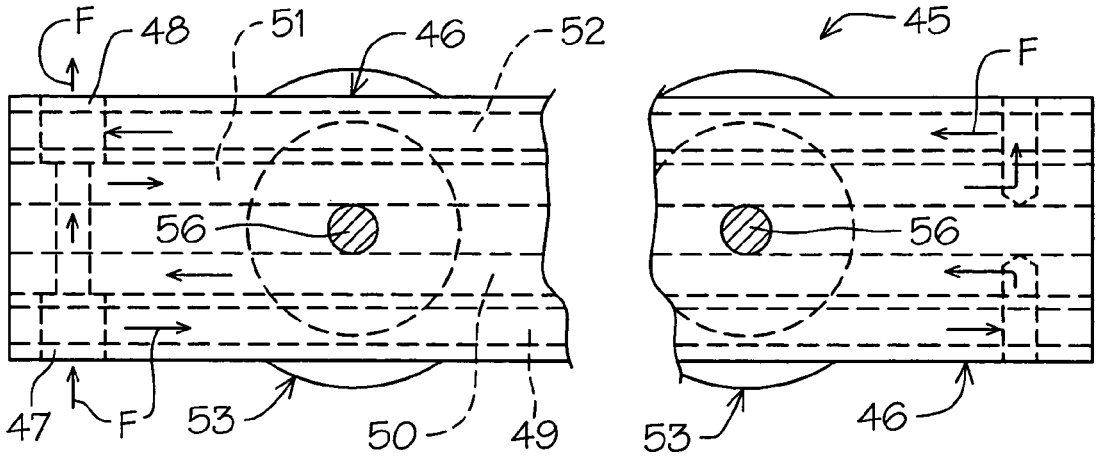
FIG. 11 is an enlarged top plan view thereof with portions broken away of the heat exchange chamber of the invention.
Figure 12:
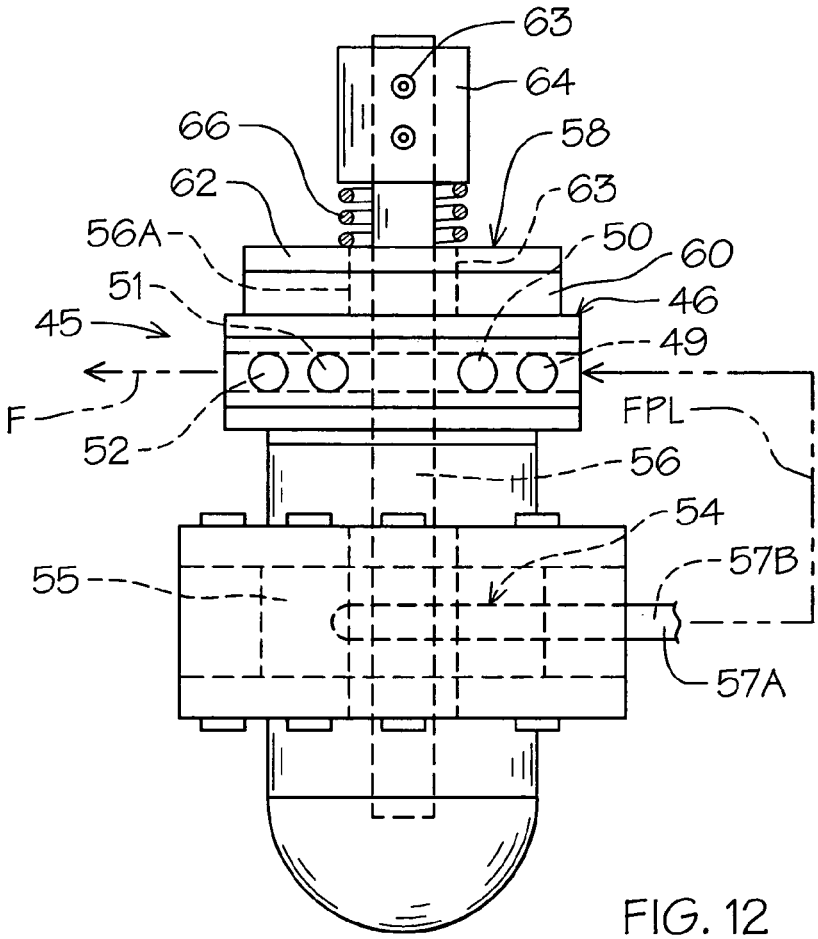
FIG. 12 is an enlarged end plan view of the alternate form of the invention.
Figure 13:
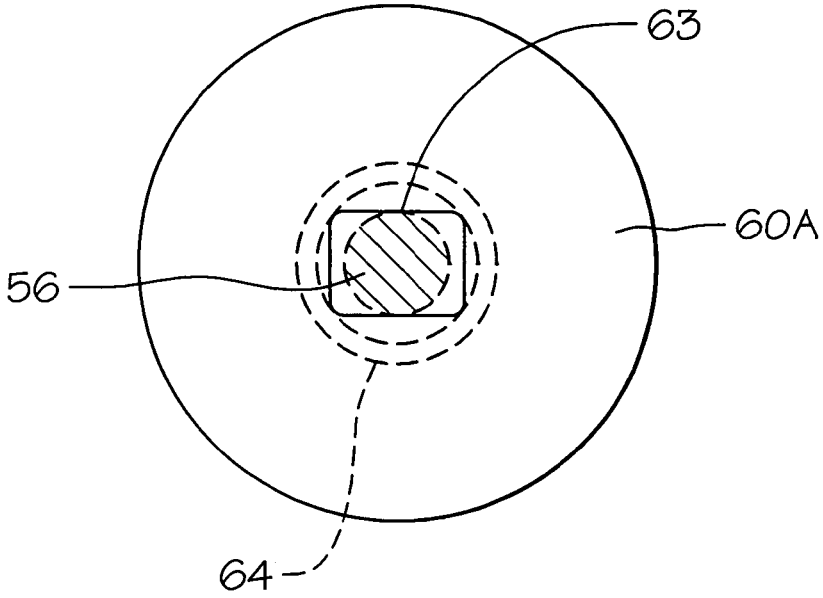
FIG. 13 is an enlarged top plan view of a friction disk of the invention.
Figure 14:
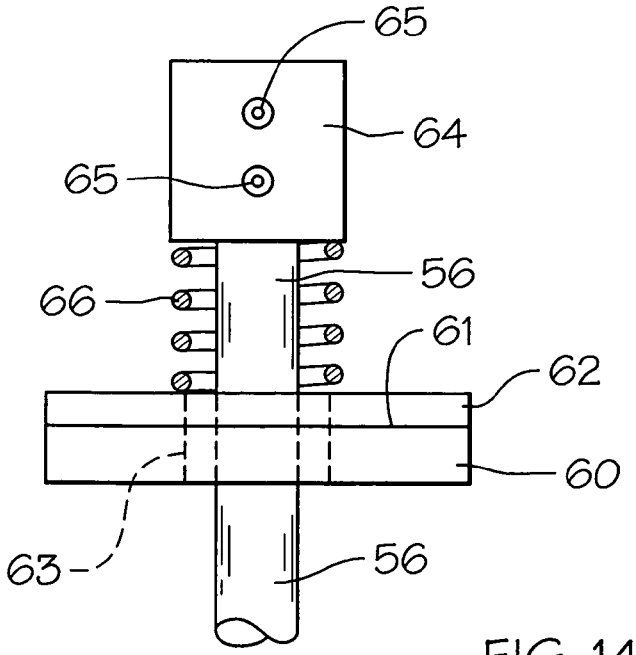
FIG. 14 is an enlarged partial side elevational view of the friction disk assembly of the invention.

Referring now to FIGS. 9–14 of the drawings, an alternate form of the invention can be seen at 45 having elongated fluid tight heat exchange chamber 46, best seen in FIGS. 9 and 11 of the drawings. The heat exchange chamber 46 has a fluid inlet 47 and oppositely disposed fluid outlet 48 interconnected by multiple tubular pathways 49, 50, 51 and 52 in communication with each other therein.

A thermal drive assembly 53 extends from the chamber 46 having a drive turbine 54 with multiple spiral oriented curved blades 55 mounted and extending from a central friction drive shaft 56. A tubular fluid inlet 57A and fluid outlet 57B provide fluid flow therethrough driving the turbine blades 55 and rotating the friction drive shaft 56 which extends through the hereinbefore described heat exchanger chamber 46.

A heat transfer disk assembly 58 is positioned for frictional contact with an outer surface 59 of the heat exchanger chamber 46 and is driven by the drive shaft 56. The heat transfer disk assembly 58 has a centrally apertured friction pad 60 with an engagement surface 60A and is formed of a traditional brake pad material which is wear resistant providing for kinetic energy to heat transfer as is well known and understood within the art. An oppositely disposed surface of the heat transfer disk assembly 58 has a pressure support backing disk 62 having a central (keyed) opening at 63 therein which extends through the corresponding abutting engagement surface pad 60. The "keyed" opening at 63 provides drive registration on the drive shaft 56 which is of corresponding keyed shape at 56A so that direct drive of the respective heat transfer disk assembly 58 is enabled upon rotation of the shaft 56 as hereinbefore described.

An adjustable locking collar 64 is removably secured to the free end of the drive shaft 56 by a pair of threaded fasteners 65. A tension spring 66 is positioned on the drive shaft 56 caged between the backing disk 62 and the collar 64 providing constant pressure on the backing disk 62 and the associated frictional pad 60 against the portion of the outer surface 59 of the heat exchange chamber 46, best seen in FIGS. 9 and 14 of the drawings.

In use, fluid flow F2 enters the drive turbine assembly 53 via the fluid inlet 57A spinning the turbine 54 and then exiting via the fluid outlet 57B continuing on into the heat exchanger chamber 46 as indicated by the broken directional flow path line FPL which can be any interconnecting conduit or corridor configuration as understood by those skilled in the art.

The drive turbine 54 spins the heat transfer disk assembly 58 which generates a thermal transfer of heat thereby into the heat exchange chamber 46 which is preferably made of material with a high heat conductivity.

It will be seen as the fluid flow F passes through the heat exchanger chamber 46, thermal energy in the form of heat is transferred thereto heating the fluid F which then exits the heat exchange chamber 46 through the fluid outlet port 48 as seen in FIG. 11 of the drawings.

It will be evident that more than one thermal drive assembly 53 can be used in aligned longitudinal spaced relation to one another on the heat exchanger chamber 45 so that fluid F passing therethrough can be consecutively heated more efficiently and to a higher temperature.

It will thus be seen that the rotating disk assemblies 28 with their configured engagement surfaces define frictional heating that is given up to the constant fluid flow within and across the heat transfer housing 23 as hereinbefore described.

It will be apparent to those skilled in the art that various changes and modifications may be made therein without departing from the spirit of the invention.

Therefore I claim:

1. A fluid heating device for heating fluid material powered by fluid flow of said fluid material comprises;

a heat exchanger chamber having pairs of transversely spaced parallel aligned interconnected bores within having a fluid inlet and a fluid outlet, at least one turbine drive assembly positioned outside of said heat exchanger chamber, a drive shaft extending from said remote turbine drive assembly through said heat exchanger chamber, means for directing a fluid flow first through said turbine drive assembly independent of said heat exchanger chamber and then through said interconnected bores within same heat exchanger chamber, a plurality of disks secured to said drive shaft outside of said heat exchanger being rotated thereby, one of said disk frictionally engaged on an outside surface of said heat exchanger chamber affording a thermal transfer thereto, means for resiliently urging said disks against said outside portion of said heat exchanger chamber, said fluid flow circulating through said heat exchanger chamber becomes heated due to the friction against a portion of said heat exchanger chamber by said disk, said heated fluid flow being isolated from said turbine drive assembly.

2. The fluid heating device set forth in claim 1 wherein said means for directing a fluid flow first through said remote turbine drive assembly and then through said heat exchanger chamber comprises, an interconnected transfer conduits therebetween.

3. The fluid heating device set forth in claim 1 wherein said turbine drive assembly comprise, a plurality of half-arcuate blades extending radially from said drive shaft.

4. The fluid heating device set forth in claim 1 wherein said means for resiliently urging said disks against said outside surface portion of said heat exchanger chamber comprises, a spring on said drive shaft between a locking collar on said shaft.

5. The fluid heating device set forth in claim 1 wherein said disks have a spring engagement portion and a heat exchanger chamber engagement portion.

* * * * *